US010455683B2

(12) United States Patent
Denning

(10) Patent No.: US 10,455,683 B2
(45) Date of Patent: Oct. 22, 2019

(54) ION THROUGHPUT PUMP AND METHOD

(71) Applicant: Agilent Technologies, Inc., Santa Clara, CA (US)

(72) Inventor: Mark Denning, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 15/169,697

(22) Filed: May 31, 2016

(65) Prior Publication Data

US 2017/0347443 A1 Nov. 30, 2017

(51) Int. Cl.

| | |
|---|---|
| ***H05H 3/02*** | (2006.01) |
| ***H01J 41/12*** | (2006.01) |
| ***H01J 27/14*** | (2006.01) |

(52) U.S. Cl.

CPC ..... *H05H 3/02* (2013.01); *H01J 41/12* (2013.01); *H01J 27/143* (2013.01)

(58) Field of Classification Search

CPC ..... H01J 41/14; H01J 41/12; H01J 27/143; H05H 3/02

See application file for complete search history.

(56) References Cited

U.S. PATENT DOCUMENTS

| | | | | |
|---|---|---|---|---|
| 2,636,664 A | | 4/1953 | Afton | |
| 2,726,805 A | | 12/1955 | Lawrence et al. | |
| 5,165,861 A | * | 11/1992 | Jahns | H02K 44/04 310/11 |
| 5,326,227 A | * | 7/1994 | Nagai | H01J 41/18 417/48 |
| 6,559,601 B1 | * | 5/2003 | Johnson | H01J 37/32834 315/111.71 |
| 6,824,363 B2 | * | 11/2004 | Mitrovic | F04B 17/00 417/48 |
| 6,873,113 B2 | * | 3/2005 | Dandl | H01J 41/20 315/111.71 |
| 2001/0016166 A1 | * | 8/2001 | Dandl | F04B 17/00 417/48 |

(Continued)

FOREIGN PATENT DOCUMENTS

| | | |
|---|---|---|
| CA | 728281 A | 2/1966 |
| GB | 684710 A | 12/1952 |

(Continued)

OTHER PUBLICATIONS

Aleksandrov, N. L. et al.; "Mechanism of ultra-fast heating in a non-equilibrium weakly ionized air discharge plasma in high electric fields"; Journal of Physics D: Applied Physics; 43, 19 pages, (2010).

Christophorou L. G. et al.; "Electron Interactions with SF6"; Journal of Physics Chemistry; National Institute of Standards and Technology; vol. 29 No. 3; Mar. 14, 2000.

(Continued)

*Primary Examiner* — Nicole M Ippolito
*Assistant Examiner* — Sean M Luck

(57) ABSTRACT

An ion throughput pump (ITP) includes a pump inlet configured to communicate with a vacuum chamber; an ionization source fluidly communicating with the vacuum chamber via the pump inlet and configured for ionizing gas species received from the vacuum chamber; a pump outlet; ion optics configured for accelerating ions produced by the ionization source toward the pump outlet; and a roughing pump stage configured for receiving the ions from the ionization source, producing neutral species from the ions, and pumping the neutral species through the pump outlet.

20 Claims, 8 Drawing Sheets

(56) References Cited

U.S. PATENT DOCUMENTS

| | | | | |
|---|---|---|---|---|
| 2003/0117080 | A1* | 6/2003 | Dandl | H01J 37/32623 315/111.81 |
| 2004/0151595 | A1* | 8/2004 | Quon | H01J 27/143 417/49 |
| 2006/0284562 | A1* | 12/2006 | Hruby | F03H 1/0075 315/111.61 |
| 2006/0290287 | A1* | 12/2006 | Kuninaka | F03H 1/0075 315/111.61 |
| 2007/0102650 | A1* | 5/2007 | Katagiri | H01J 37/18 250/492.3 |
| 2008/0136309 | A1* | 6/2008 | Chu | H01J 27/146 313/361.1 |

FOREIGN PATENT DOCUMENTS

| | | | |
|---|---|---|---|
| GB | 762365 | A | 11/1956 |
| GB | 831697 | A | 3/1960 |
| GB | 1045721 | A | 10/1966 |
| GB | 1268381 | A | 3/1972 |

OTHER PUBLICATIONS

Hargus, Jr, William Anthony; "Investigation of the Plasma Acceleration Mechanism Within a Coaxial Hall Thruster"; High Temperature Gasdynamics Laboratory Thermosciences Division; Stanford University; Report No. TSD-130; Mar. 2001.

Kaufman, Harold R. et al.; "End-Hall ion source"; Journal of Vacuum Science & Technology A5; pp. 2081-2084 (1987).

Lam, Cheryl M. et al.; "A 2-D Hybrid Hall Thruster Simulation That Resolves the E×B Electron Drift Direction"; IEEE Transactions on Plasma Science, vol. 43, No. 1, Jan. 2015.

Mikellides, Ioannis G. et al.; "Hall-Effect Thruster Simulations with 2-D Electron Transport and Hydrodynamic Ions"; The 31st International Electric Propulsion Conference, University of Michigan, 2009.

Raitses, Y. et al.; "Parametric investigations of a nonconventional Hall thruster" Physics of Plasmas; vol. 8, No. 5, May 2001.

Kanie, T.; "Secondary electron spectra from a tantalum surface by multiply charged ions"; National Institute of Fusion Science; Surface Science 242 (1191) pp. 417-421.

European Search Report dated Oct. 24, 2017 from related European Application No. GB1708301.5.

* cited by examiner

ION THROUGHPUT PUMP AND METHOD

TECHNICAL FIELD

The present invention relates to an ion throughput pump effective for creating a high vacuum or ultra-high vacuum in an enclosed space.

BACKGROUND

A variety of vacuum pump types are available that are capable of achieving ultra-high vacuum (UHV, around $10^{-9}$ Torr or lower). Historically the pump of choice was the oil diffusion pump, which uses conical streams of oil to impart momentum on gas molecules.

One of the most popular pump types used today is the turbomolecular pump, which uses fast-spinning blades to impart momentum to gas molecules to maintain a pressure differential. While such pumps provide an oil-free solution for reaching UHV, as they are mechanical devices they can suffer mechanical failures. They also can create noise and vibration that can have a negative impact on a vacuum process.

Pumps that ionize gas and trap the ionized gas on surfaces within the pump, e.g. sputter ion pumps (SIPs) are also available. While these are also oil-free and additionally are non-mechanical, they suffer from saturation effects, and the sputtering away of material can limit their lifetime by creating holes in cathode plates and causing electrical shorts when portions of the cathode break away. These problems are particularly acute when operating at higher pressures (e.g. greater than $10^{-6}$ Torr).

Further examples of pumps that ionize gas are described by Haine, "Improvements relating to high vacuum pumps," UK Patent No. 684710 (1952), and Farnsworth, "Vacuum Pump," Canadian. Patent No. 728281 (1966).

There is an ongoing need for vacuum pumps capable of achieving UHV while addressing the problems conventionally associated with mechanical pumps such as turbomolecular pumps and ion pumps such as SIPs.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to an embodiment, an ion throughput pump (ITP) includes: a pump inlet configured to communicate with a vacuum chamber; an ionization source fluidly communicating with the vacuum chamber and configured for ionizing gas species received from the vacuum chamber; a pump outlet; ion optics configured for accelerating ions produced by the ionization source toward the pump outlet; and a roughing pump stage configured for receiving the ions from the ionization source, producing neutral species from the ions, and pumping the neutral species through the pump outlet.

According to another embodiment, the ionization source includes a plasma source.

According to another embodiment, the plasma source is a Hall-effect plasma source.

According to another embodiment, an ion throughput pump (ITP) system includes: a vacuum chamber; and an ITP according to any of the embodiments disclosed herein, wherein the ITP is fluidly coupled to the vacuum chamber.

According to another embodiment, a method for evacuating a vacuum chamber includes: receiving gas species from the vacuum chamber into an ionization chamber; generating an electric field in the ionization chamber to produce ions from the gas species and accelerate the ions away from the ionization chamber and toward a pump outlet; neutralizing the ions to produce neutralized species; and pumping the neutralized species out from the pump outlet.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

The present disclosure describes a type of vacuum pump referred to herein as an ion throughput pump (ITP). As will become evident from the following description, an ITP as disclosed herein ionizes gas species (molecules or atoms), as in ion pumps. However, rather than trapping the ions on and in the surfaces of the pump, the ITP utilizes electric fields to accelerate these ions out of the vacuum system to maintain a pressure differential. The ITP is an "all-electric" (predominantly non-mechanical) pump that is oil-free and vibration-free. The ITP does not utilize unreliable mechanical elements that require maintenance and are the primary failure mechanism of turbomolecular pumps and other mechanical pumps. The fast-spinning rotors of large turbomolecular pumps also present a safety hazard due to the potential for extremely high forces to occur in the event of a "crash" failure, which necessitates a thick housing and secure mounting to prevent the pump from exploding or coming loose and forming a dangerous projectile. The ITP does not present this risk. Moreover, leaks that result in a rapid increase in pressure can induce axial force on turbomolecular pump rotors, which can result in pump wear or crash failure. By contrast, the ITP has no rotational momentum and may be shut down essentially instantaneously. The ITP also may be more readily scaled down to form miniature or micro-pumps, in comparison to the mechanical turbomolecular pump architecture, and may be configured to mate to non-circular pumping ports.

As used herein, the term "vacuum chamber" encompasses a chamber (i.e., an enclosed space capable of being fluidly sealed in a vacuum-tight manner) that is part of or in fluid communication with an ITP as disclosed herein. Depending on the context or stage of operation, a "vacuum chamber" is at a vacuum pressure (e.g., at a sub-atmospheric pressure down to $10^{-9}$ Torr or lower) as result of operating the ITP (i.e., the vacuum chamber has been evacuated), or is at least capable of being pumped down to a vacuum pressure due to being part of or in fluid communication with the ITP.

Figure 1:
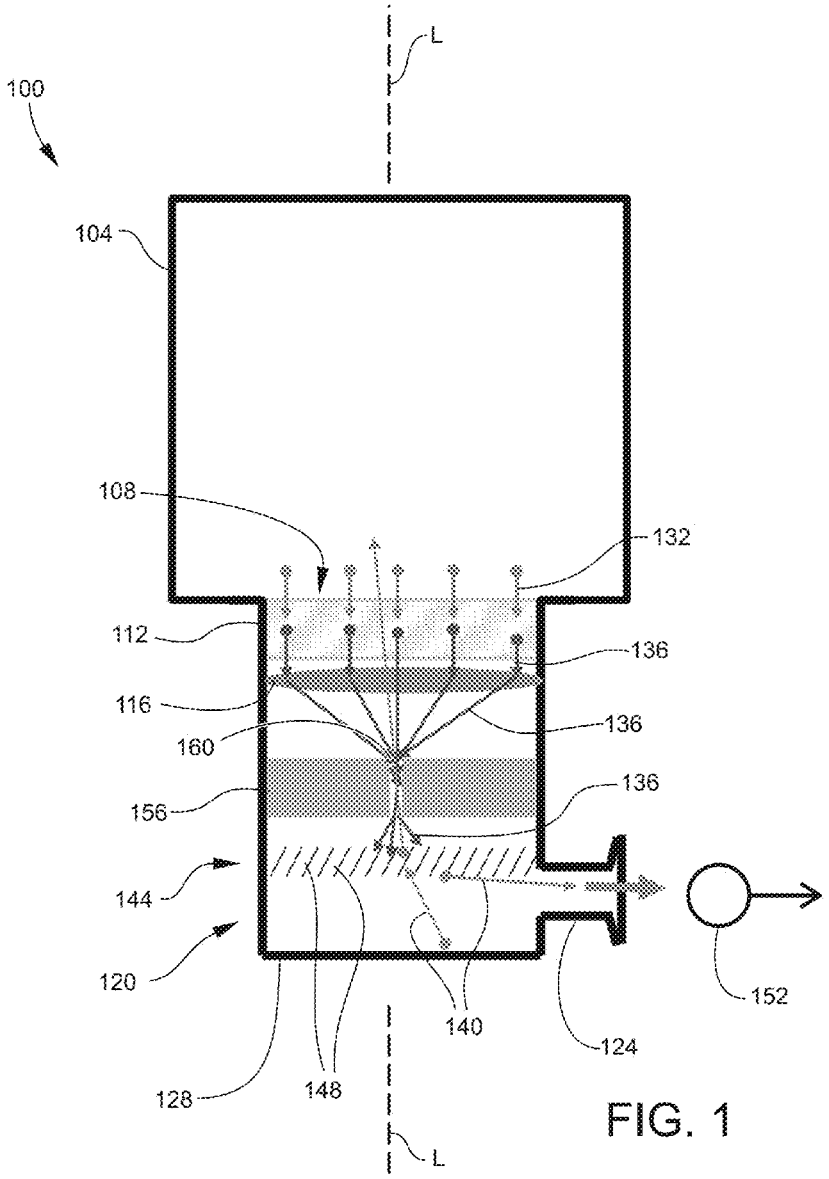
FIG. 1 is a schematic cross-sectional view of an example of an ion throughput pump (ITP) according to an embodiment.

FIG. 1 is a schematic cross-sectional view of an example of an ion throughput pump (ITP) 100 according to an embodiment. For illustrative purposes, the ITP 100 may be considered as having a longitudinal axis L relative to which the positions of various components of the ITP 100 may be referenced. Generally, the ITP 100 may include (or be configured to be coupled to) a vacuum chamber 104, a pump inlet 108, an ionization source or region 112, ion optics 116, a roughing pump stage or chamber 120 (or rough vacuum stage or chamber), and a pump outlet 124. The ITP 100 may also generally include an outer pump housing 128 configured (structured, shaped, positioned, sized, etc.) to enclose the foregoing components. The pump inlet 108 and the pump outlet 124 may be formed at or through one or more walls of the pump housing 128, and may respectively provide the only paths for gas species to enter and exit the ITP 100.

Generally, the vacuum chamber 104 may be any vacuum-tight enclosed space that is desired to be evacuated by the ITP 100. The vacuum chamber 104 may be, or be part of, any device or system that utilizes an evacuated region such as a scientific instrument or a fabrication instrument. Examples of scientific instruments include, but are not limited to, mass spectrometers, ion mobility spectrometers, gas leak detectors, and electron microscopes. Examples of fabrication instruments include, but are not limited to, instruments that utilize evacuated reaction chambers to fabricate components for microelectronics, microelectromechanical systems (MEMS), microfluidics, and the like. Such fabrication instruments may, for example, utilize techniques involving vacuum deposition, plasma generation, electron beam generation, molecular beam generation, ion implantation, and the like as appreciated by persons skilled in the art.

Depending on the embodiment, the vacuum chamber 104 may be considered as being a part of the ITP 100 or as a separate component to which the ITP 100 is coupled by way of a suitable vacuum-tight connection such as a vacuum flange. Thus also depending on the embodiment, the housing enclosing the vacuum chamber 104 may be considered as being integral with the pump housing 128 or as a separate housing that is coupled to the pump housing 128. When the vacuum chamber 104 and the ITP 100 are considered to be integral or otherwise forming a singular entity, the vacuum chamber 104 and the ITP 100 may be collectively referred to as an ITP system (or device) or a vacuum system (or device). In either case, the pump inlet 108 serves as the interface between the vacuum chamber 104 and the ionization source 112. That is, the vacuum chamber 104 fluidly communicates with the ionization source 112 at the pump inlet 108, whereby the pump inlet 108 provides (establishes, defines) a path for initially neutral gas species 132 to enter the ionization source 112 from the vacuum chamber 104 such as by diffusion or additionally rough pumping action as described below.

The ionization source 112 may be any device or system configured to ionize the gas species 132 received from the vacuum chamber 104, thereby producing ions 136. The ionization source 112 generally defines an ionization region in the pump interior, and includes a device that applies electromagnetic energy (e.g., electrical energy, ultraviolet energy, etc.) to the ionization region effective for ionizing atoms and molecules. In some embodiments, the ionization source 112 is a plasma-based ionization source. Other types of ionization sources may be suitable, particularly those configured for implementing electron (impact) ionization (EI) using electron beams.

Operation of the ITP 100 requires the presence of free electrons in order to achieve EI. There are a number of methods to provide these electrons. Inherently electrons will result from the ionization of the gas species. Electrons may also enter the discharge due to surface processes. For instance, secondary electrons may be created by energetic particles (such as electrons, ions, energetic neutral particles, and UV photons) that impact dielectric or conductive surfaces in the ITP 100.

Depending on the embodiment, the ionization source 112 may or may not include a distinct device for use as a source of seed electrons for striking or maintaining the plasma (e.g., a thermionically emitting cathode such as a hot filament or disk (composed of, for example, tungsten, a tungsten alloy, or other suitable thermionically emitting material), hollow cathode, field-emission device, or the like). Thermionic emitters may have coatings (e.g. yttria) or formulations that improve their robustness for operation at mTorr-scale pressures, as appreciated by persons skilled in the art. Hollow cathodes in which electrons are extracted from a plasma source may be less preferred due to the additional source of gas required to operate these electron sources, particularly when considering that an objective of the ITP 100 is to remove gas. The most advantageous position for such electron sources may be in the cathode region (generally located downstream, or below, the ionization region in the illustrated embodiment) so that the electric field accelerates the free electrons upstream into the ionization region. The electrons emitted from these electron sources may significantly influence the local electric field and potential, and may form a so-called virtual cathode that accelerates ions in conjunction with any conductive cathode electrodes to which a potential is applied. The ITP 100 may utilize any combination of electron sources.

The ion optics 116 may generally include an arrangement of one or more electrodes configured for accelerating the ions 136 produced by the ionization source 112 away from the vacuum chamber 104 and generally toward the pump outlet 124. For this purpose, one or more of the electrodes may be structured as a plate, a ring, a cylinder, a grid (e.g., mesh, screen, etc.), a portion of a wall of the ITP 100, etc., and may be positioned in the interior of the ITP 100, as needed for generating an electric field of suitable strength, spatial position and orientation, effective for urging the ions 136 generally toward the pump outlet 124. Typically, the electric field is an electrostatic field but alternatively may be a periodic electric field.

In some embodiments, the ion optics 116 or some portion thereof may be configured to be mass-selective. For this purpose, the ion optics 116 may include a quadrupole arrangement of electrodes (e.g., a quadrupole mass filter), an electric sector and/or magnetic sector, a Bradbury-Nielsen (BN) gate, etc. Mass-selective ion optics may be useful in an application where a particular contaminant is to be removed from the vacuum chamber 104. Mass-selective ion optics are generally known to persons skilled in the art, and thus need not be further described herein.

Generally, the roughing pump stage 120 is configured for receiving the ions 136 from the ion optics 116, producing neutral gas species 140 (or "neutralized species") from the ions 136, and pumping the neutral species 140 through the pump outlet 124. To neutralize the ions 136, the roughing pump stage 120 may generally include a neutralization section or region 144. The neutralization section 144 may include, for example, one or more plates 148 (e.g., baffles or the like) that are positioned and oriented so as to partially obstruct the path of the ions 136, thereby creating a high probability that the ions 136 impinge on the plates 148 and consequently become neutralized, while allowing the resulting neutral species 140 to flow beyond the neutralization section 144 toward the pump outlet 124. In the illustrated embodiment, a serial arrangement of plates 148 is mounted such that the plates 148 span the entire or substantially the entire cross-sectional flow area of the ITP 100 at the location of the neutralization section 144, although other geometries and arrangements for neutralization elements may alternatively be provided. The neutralization section 144, such as the illustrated plates 148, also may be configured or effective for preventing neutral gas species 140 from back-scattering back through the neutralization section 144 in the upstream direction.

In some embodiments, the plate(s) 148 may be utilized as an electrode, and thus also may be referred to herein as a neutralization electrode. The plate(s) 148 may be considered as being part of the ion optics 116, for example as being the last cathode of the ion optics 116.

The electrical current drawn at the neutralizing electrode may be an approximate measure of the pressure in the ITP 100, so that the ITP 100 may also operate as a pressure gauge. As a non-mechanical device, the ITP 100 lacks rotational momentum and thus can be shutoff nearly instantaneously in comparison with turbomolecular pumps and other mechanical pumps. The pump current drawn at the neutralizing electrode may be used as a feedback signal to trigger pump shutoff to avoid electrical arcing that could occur at higher pressures.

The roughing pump stage 120 also may include a roughing pump unit 152 (a roughing pump or "backing" pump). Generally, the roughing pump unit 152 may be any type of vacuum pump capable of providing a pressure differential effective for driving the neutral gas species 140 through the pump outlet 124, and thereby pumping the vacuum chamber 104 and roughing pump stage 120 down to a "rough" or "backing" vacuum level. The roughing pump unit 152 is typically a mechanical pump. The roughing pump unit 152 may provide a relatively low or "rough" vacuum level of, for example, down to about $10^{-3}$ Torr. Examples of pumps that may be suitable for use as the roughing pump unit 152 include, but are not limited to, scroll pumps, rotary vane pumps, diaphragm pumps, Roots blower (positive displacement lobe) pumps, etc. In FIG. 1, the roughing pump unit 152 is schematically illustrated as being positioned downstream from the illustrated pump outlet 124. Alternatively, the roughing pump unit 152 may be positioned in the region of the roughing pump stage 120 between the neutralization section 144 and the pump outlet 124. The pump outlet 124, or the outlet of the roughing pump unit 152 if positioned downstream from the illustrated pump outlet 124, may be open to the ambient outside of the ITP 100, or may lead to an enclosed space that nonetheless is external to the vacuum chamber 104 and the intervening ITP 100.

In some embodiments, the roughing pump unit 152 may be provided in the form of multiple pumps in series. In some embodiments, the roughing pump unit 152 may include a roughing pump and a series of one or more rotary drag stages as may be found in turbomolecular pumps, to produce a transitional or molecular flow regime backing pressure for the ITP 100.

Figure 5:
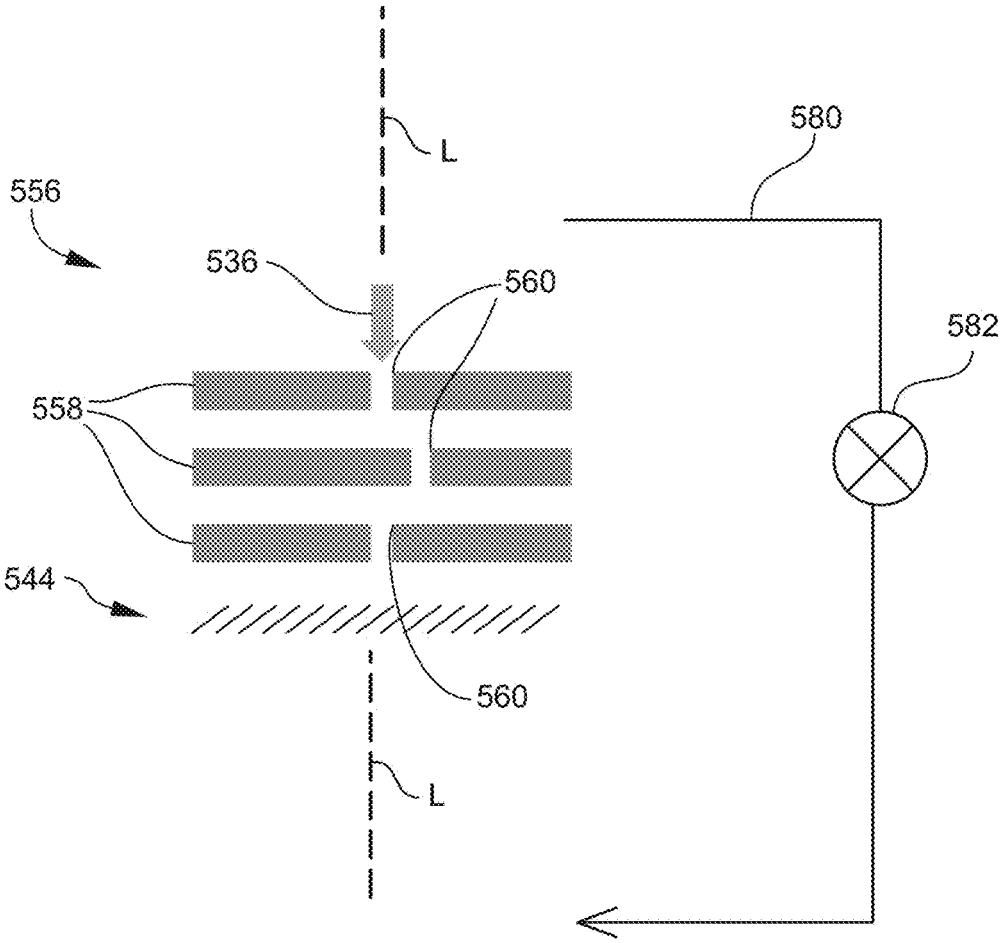
FIG. 5 is a schematic cross-sectional view of an example of a gas conductance barrier 556 according to an embodiment.

The ITP 100 may further include a gas conductance barrier 156 generally positioned (and providing the interface) between the upstream high vacuum region and the downstream rough vacuum region. The gas conductance barrier 156 may be or include, for example, a plate or other solid structure that spans the entire or substantially the entire cross-sectional flow area of the ITP 100 at the location of the gas conductance barrier 156, and includes a relatively small-diameter orifice 160 extending through the thickness of the plate. By this configuration, the gas conductance barrier 156 provides a path for ions 136 to be transmitted through the orifice 160 and into the neutralization section 144, but the path is a low-conductance path for gas species. The gas conductance barrier 156 thus prevents back-streaming of neutral gas species 140 in the upstream direction (i.e., toward the ionization source 112 and the vacuum chamber 104). The gas conductance barrier 156 may be part of the ion optics 116. That is, the gas conductance barrier 156 may be realized as one or more electrodes, or ion "lenses," that are coupled to voltage sources or are electrically grounded. In some embodiments, the gas conductance barrier 156 may include a coaxial series of thin orifices, such as in the configuration of an Einzel lens. In some embodiments, the gas conductance barrier 156 may include a series of thin orifices in which one or more of the orifices are offset from the other orifices, as illustrated in FIG. 5 and described below. In some embodiments, the gas conductance barrier 156 may be a tubular electrode in which the length of the orifice is similar to or greater than the diameter, which has a lower gas conductance than a thin orifice.

A typical yet non-exclusive example of a general operation of the ITP 100, i.e., a method for evacuating the vacuum chamber 104, will now be described. As an initial step, before activating the ionization source 112, the roughing pump unit 152 may be activated first to provide a first stage of pump-down of the vacuum chamber 104 as well as the interior of the ITP 100. The initial operation of the roughing pump unit 152 brings the vacuum chamber 104 and the ITP 100 down to a slight or low level of vacuum, creating a pressure differential that achieves an initial purging of the vacuum chamber 104 of gas species 132. Under the influence of this pressure differential, gas species 132 in the vacuum chamber 104 begin to flow into the pump inlet 124, through the interior regions of the ITP 100, and out from the pump outlet 124. The ionization source 112 is then activated to apply energy (in a manner dependent on its principle of operation) to the ionization region, whereby gas species 132 exposed to the energy are ionized. The ion optics 116 are also activated at this time to impart an electric field to the interior of the ITP 100. The resulting ions 136 are accelerated toward the gas conductance barrier 156 and have sufficient kinetic energy to pass through its orifice 160 and into the neutralization section 144, where the ions 136 collide with the plate(s) 148 and are neutralized thereby. The resulting neutral gas species 140 are then pumped out through the pump outlet 124. By this operation, embodiments of the ITP 100 are capable of pumping the vacuum chamber 104 down to high vacuum, e.g., in a range from about $10^{-3}$ to about $10^{-9}$ Torr, and even down to ultra-high vacuum (UHV), e.g., in a range of about $10^{-9}$ Torr and lower.

Figure 2:
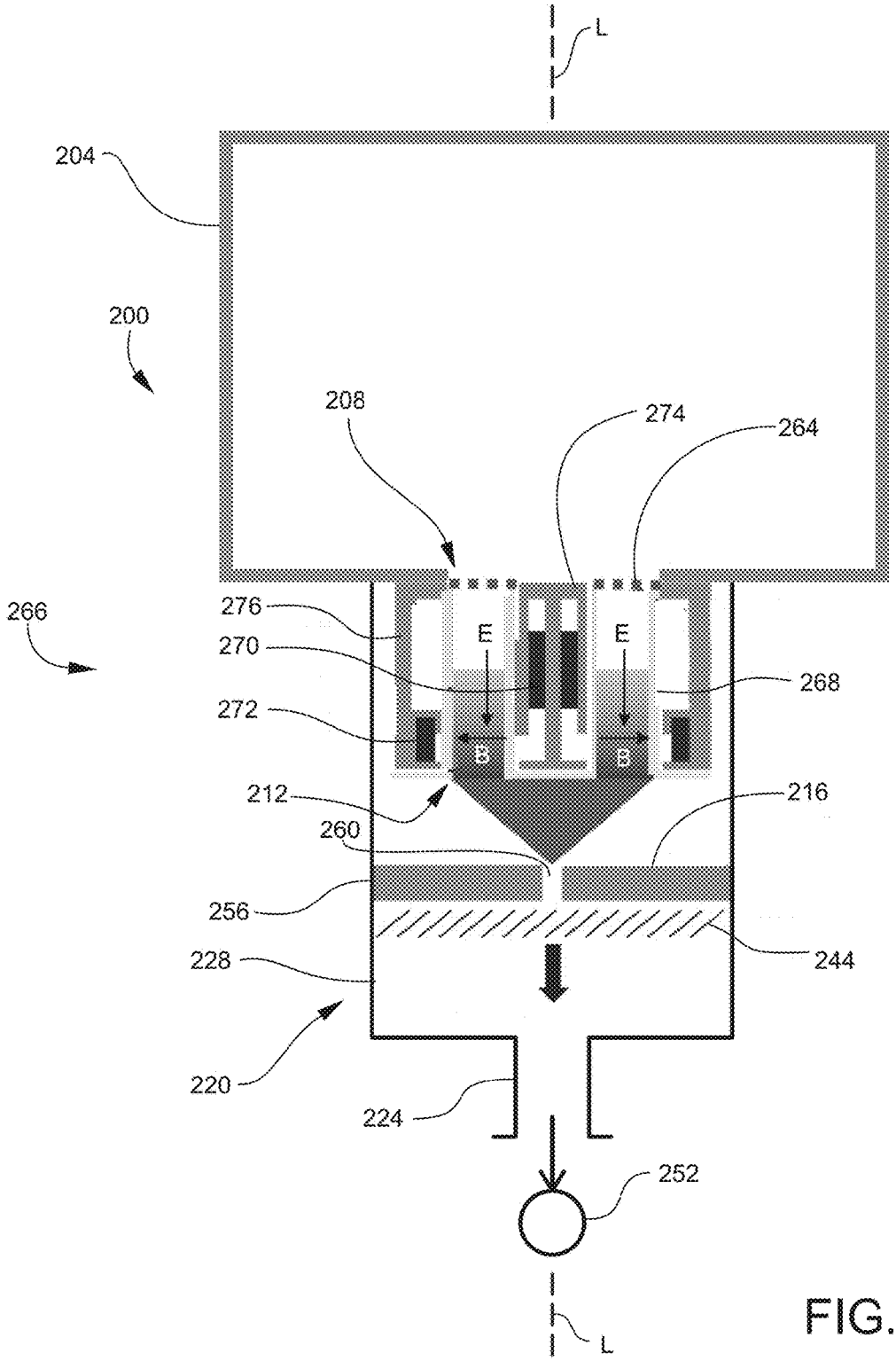
FIG. 2 is a schematic cross-sectional view of an example of an ITP according to another embodiment.

FIG. 2 is a schematic cross-sectional view of an example of an ion throughput pump (ITP) 200 according to another embodiment. For illustrative purposes, the ITP 200 may be considered as having a longitudinal axis L relative to which the positions of various components of the ITP 200 may be referenced. Generally, the ITP 200 may include (or be configured to be coupled to) a vacuum chamber 204, a pump inlet 208, an ionization source or region 212, ion optics 216, a roughing pump stage or chamber 220, and a pump outlet 224. The ITP 200 may also generally include an outer pump housing 228 configured (structured, shaped, positioned, sized, etc.) to enclose the foregoing components. As noted above, depending on the specific embodiment, the ITP 200 and its outer pump housing 228 may be considered as being integral with, and as separate components from, the vacuum chamber 204 and its outer housing. The roughing pump stage 220 may include a neutralization section 244, and also may include roughing pump unit 252, as described herein.

In the present embodiment, the ion optics 216 include an inlet electrode (or entrance electrode) 264 positioned at or near the pump inlet 208, which may serve as the anode for applying the voltage that powers the ionization source 212 and the ion accelerating field. As illustrated, the inlet electrode 264 may be a gridded electrode or multi-channel plate that is sized and positioned so as to span the cross-sectional area of the pump inlet 208. By this configuration, the inlet electrode 264 allows gas to diffuse from the vacuum chamber 204 into the ionization region of the ionization source 212, and also may be utilized to generate an electrical field through the ionization region. The ITP 200 may further include a gas conductance barrier 256 with an orifice 260, which may be part of the ion optics 216 as described herein.

In the present embodiment, the ionization source 212 is a plasma-based ionization source. More specifically, the ionization source 212 is configured for generating a Hall-effect plasma discharge. To this end, the ionization source 212 may include a magnet assembly 266 and an annular ionization chamber 268. The magnet assembly 266 and the annular ionization chamber 268 may be coaxial with each other, and in the illustrated example are coaxial with the longitudinal axis L generally associated with the ITP 200. The magnet assembly 266 is configured to generate a magnetic field in the ionization region that is predominantly oriented in the radial direction orthogonal to the longitudinal axis L, as indicated by arrows B in FIG. 2. For this purpose, in the illustrated example the magnet assembly 266 includes one or more inner magnets 270 positioned at or near the longitudinal axis L, and one or more outer magnets 272 positioned at a radial distance from the inner magnet(s) 270 relative to the longitudinal axis L. The magnet assembly 266 may further include a ferromagnetic structure configured to shape the magnetic field produced by the magnets 270 and 272. For example, the magnet assembly 266 may include one or more support structures (e.g., support structures 274 and 276) that support, and/or form a magnetic circuit with, the inner magnet(s) 270 and the outer magnet(s) 272. Depending on the configuration (e.g., size, orientation) of the magnetic field to be realized, such support structures may include a combination of structures composed of magnetically permeable (magnetizable) materials (e.g. pole pieces) and non-magnetic materials, as appreciated by persons skilled in the art. The magnets 270 and 272 may be permanent magnets or electromagnets. The annular ionization chamber 268 may be formed by one or more walls (e.g., a cylindrical inner wall and a cylindrical outer wall radially spaced therefrom) composed of a non-magnetic, dielectric material. In such embodiment the pump inlet 208 provides a fluid interface between the vacuum chamber 204 and the annular ionization chamber 268, and the inlet electrode 264 may be annular as well.

In operation, a high DC voltage is applied to electrodes (e.g., the inlet electrode 264 and the gas conductance barrier 256, or other electrodes) to generate a strong axial electric field (i.e., in the direction of the longitudinal axis L) through the ionization region, as indicated by arrows E. Hence, the axially oriented electric field E in combination with the radially oriented magnetic field B forms an E×B ("E cross B") field in which the directions of the electric field E and the magnetic field B are orthogonal to each other (as may be envisioned by electric and magnetic field lines). Gas species received from the vacuum chamber 204 are energized by the electric field E. Thus, the gas species being removed from the vacuum chamber 204 serve as the working gas for forming a plasma in the ionization region. The plasma species in this case include the ionized gas species and free electrons. The plasma is formed (struck) and maintained by continuous application of the electric field E. The electrons in the plasma form a cylindrical current due to the E×B drift phenomena in which charged particles drift in a direction perpendicular to both the electric and magnetic fields. These confined electrons continuously ionize the incoming gas, and the ions that are formed are accelerated by the strong electric field to high energies toward the roughing pump stage 220 and pump outlet 224. The ionization source 212 so configured may exhibit extremely high mass utilization efficiency (effectively 100%, or approaching 100%), such that virtually all gas species that pass into the ionization region are ionized and accelerated away from the ionization region.

As described above, in some embodiments, the ITP 200 may include an electron source (e.g., a thermionic emitter) configured to supply electrons to the ionization region and form a virtual cathode. In some embodiments, the impact by ions or other plasma species on one or more electrodes of the ion optics 216 in the cathode region (generally located downstream, or below, the ionization region in the illustrated embodiment) may induce secondary emission of electrons that supply electrons to the plasma discharge.

In many processes that occur in vacuum chambers, it is desirable to minimize or control the electric fields within the vacuum chambers. For this reason, it may be desirable to hold the inlet electrode 264 at the electric potential of the vacuum chamber 204 itself, which is typically considered to be the system ground. Similarly, some processes performed in vacuum are sensitive to stray magnetic fields. It therefore may be advantageous to provide a means to prevent the magnetic field of the ITP 200 from penetrating into the vacuum chamber 204. In one embodiment, this may be achieved by increasing the distance between the magnet assembly 264 and the pump inlet 208. Alternatively or additionally, this may be achieved by using a magnetic material in the pump housing 228 that prevents magnetic field lines from penetrating into the vacuum chamber 204. This magnetic material may be independent or an integral part of the magnetic circuit of the magnet assembly 264. In an embodiment, the inlet electrode 264 may be made of such a material, and may simultaneously provide shielding of the electric and magnetic fields of the ITP 200, and of particles as described further herein. Electric or magnetic fields may be introduced at the pump inlet 208 to deflect charged particles (e.g. electrons or ions) thereby preventing them from entering the vacuum chamber.

Figure 3:
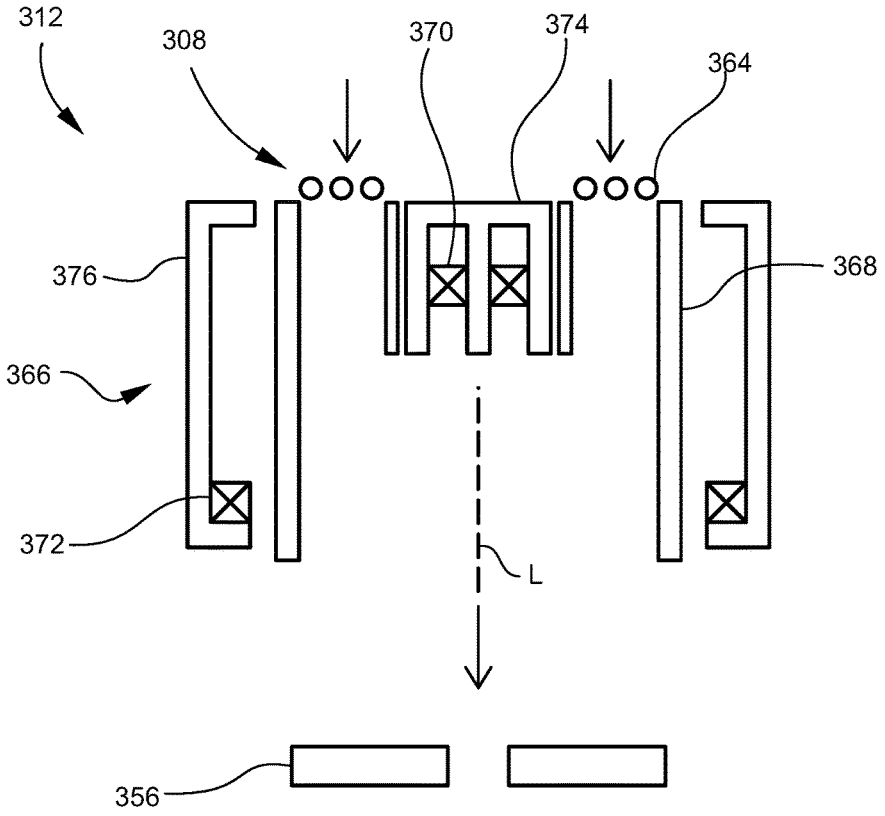
FIG. 3 is a schematic cross-sectional view of an example of an ionization source according to an embodiment.

FIG. 3 is a schematic cross-sectional view of an example of an ionization source 312 according to another embodiment. The ionization source 312 may be included in any of the ITPs disclosed herein. Like the ionization source 212 described above and illustrated in FIG. 2, the ionization source 312 is configured for generating a Hall-effect plasma discharge in which the electrons form a cylindrical current orthogonal to both the electrical and magnetic components of an E×B field. Accordingly, the ionization source 312 may include a magnet assembly 366 that includes one or more inner magnets 370 positioned at or near the longitudinal axis L, one or more outer magnets 372 positioned at a radial distance from the inner magnet(s) 370 relative to the longitudinal axis L, and one or more support structures 374 and 376 supporting and forming a magnetic circuit with the inner magnet(s) 370 and the outer magnet(s) 372. The ionization source 312 may further include an ionization chamber 368. For reference purposes, FIG. 3 also shows an inlet electrode 364 located at a pump inlet 308, a cathode 356 (which may be one or more electrodes) positioned downstream from the ionization region, upper arrows depicting ingress of gas species from a vacuum chamber (not shown), and a lower arrow depicting egress of ions from the ionization source 312, as described above.

The ionization source 312 of FIG. 3 differs from the ionization source 212 of FIG. 2 in that the central portion of the magnetic circuit of the ionization source 312 is recessed, such that a main portion of the plasma discharge occurs in a cylindrical region as opposed to an annular region. Thus, the ionization chamber 368 includes an annular section of relatively short axial length communicating with the pump inlet 308, followed by a cylindrical section. The cylindrical geometry of the present embodiment may provide better performance in an ITP scaled-down to a smaller geometry and lower power. The cylindrical geometry may provide more axially-directed ion velocities as compared to the predominantly annular geometry of the ionization source 212 of FIG. 2.

Figure 4:
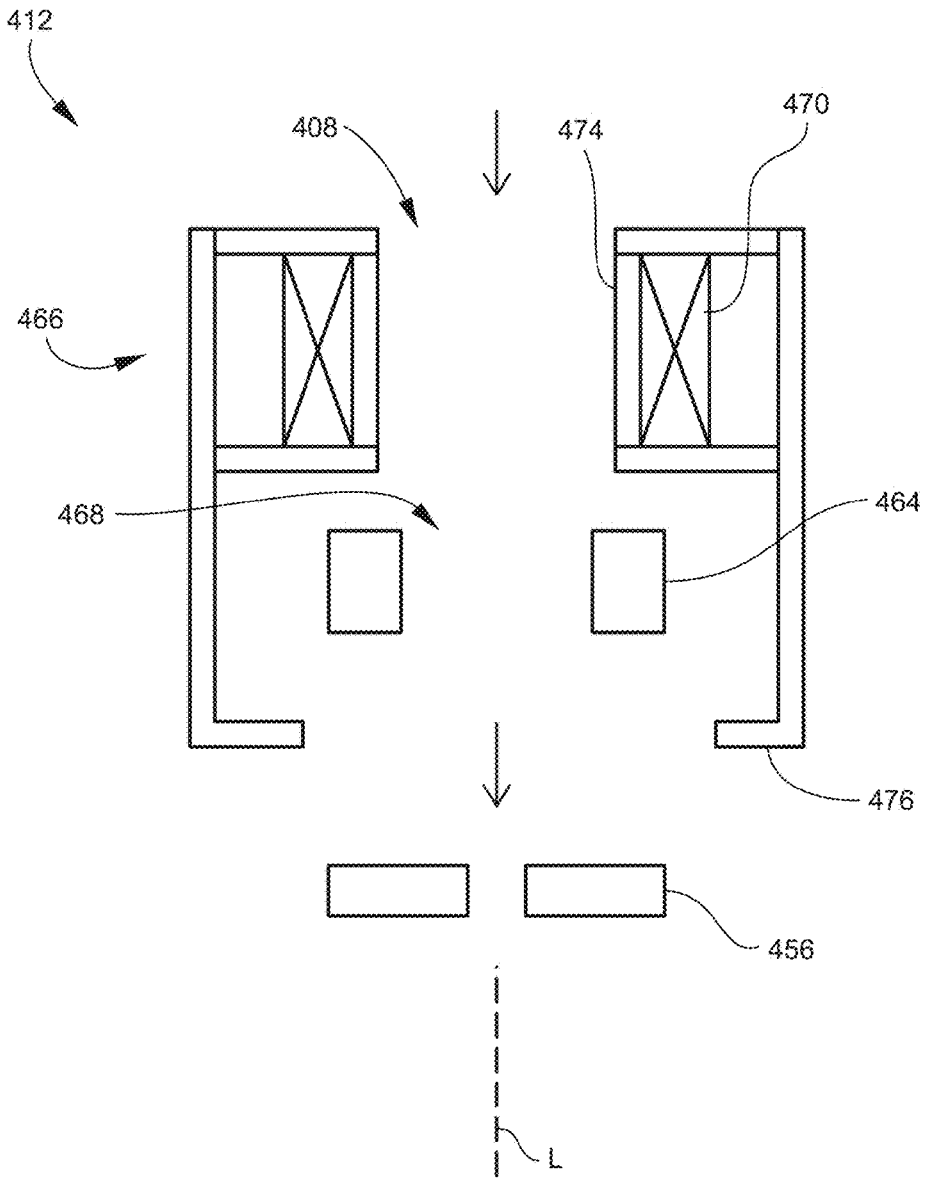
FIG. 4 is a schematic cross-sectional view of an example of an ionization source according to another embodiment.

FIG. 4 is a schematic cross-sectional view of an example of an ionization source 412 according to another embodiment in which the ionization source 412 is configured as an "end-Hall" ionization source. The ionization source 412 may be included in any of the ITPs disclosed herein. The ionization source 412 may include a magnet assembly 466 configured as a solenoid positioned at or near the longitudinal axis L. The magnet assembly 466 includes a magnet 470 (typically an electromagnet) wound about a core 474 (e.g., a coil former or inner pole piece), and other support structures (e.g., support structure 476) as needed to form a magnetic circuit. The ionization source 412 may further include an ionization chamber or region 468 that is generally defined in the vicinity of an anode 464. The anode 464 may be cylindrical or toroidal as illustrated. For reference purposes, FIG. 4 also shows a pump inlet 408, a cathode 456 (which may be one or more electrodes) positioned downstream from the ionization region 468, an upper arrow depicting ingress of gas species from a vacuum chamber (not shown), and a lower arrow depicting egress of ions from the ionization source 412, as described above. In this embodiment, gas species from the vacuum chamber enter a region surrounded by the magnet 470, and the plasma discharge is generated primarily in the decaying magnetic field located beyond the axial end (the lower end, from the perspective of FIG. 4) of the solenoid (i.e., the magnet 470 wound about the core 474) in the vicinity of the anode 464.

FIG. 5 is a schematic cross-sectional view of an example of a gas conductance barrier 556 according to an embodiment. The gas conductance barrier 556 may be included in any of the ITPs disclosed herein. For reference purposes, FIG. 5 also shows an ion beam 536 and a neutralization section 544. The gas conductance barrier 556 includes a stack of ion lenses axially spaced from each other along the longitudinal axis L. Each ion lens is a thin plate 558 with an orifice 560 formed through its thickness. One or more of the orifices 560 may be positioned on the longitudinal axis L, while one or more other orifices 560 may be offset from the longitudinal axis L. As illustrated, the gas conductance barrier 556 may be configured such that the orifices 560 of adjacent plates 558 are offset from each other relative to the longitudinal axis L. This staggered configuration may be useful for preventing sputtered material originating from the neutralization section 544 from back-streaming in the upstream direction toward the ionization region and the vacuum chamber.

While a low gas conductance is useful for operation of the ITP, it is not conducive to achieving a rapid pump-down from atmospheric pressure to rough vacuum pressure. Thus, as schematically depicted in FIG. 5, in some embodiments the ITP (e.g., ITP 100 or 200) may include a bypass channel 580 (e.g., one or more conduits) that provides a fluid flow path that bypasses the gas conductance barrier 556 (and possibly also the neutralization section 544), and one or more valves 582 that control whether the bypass channel 580 is open or closed. In operation, the valve 582 is open during the initial pump-down stage to enable the gas species to bypass the gas conductance barrier 556 and flow unobstructed to the pump outlet. After the initial pump-down stage, the valve 582 is closed around the time that the ionization source is activated so that all subsequent mass flow goes through the gas conductance barrier 556.

In some embodiments, the ITP (e.g., ITP 100 or 200) may include one or more non-evaporable getters (NEGs) positioned at one or more locations in the ITP to provide supplemental vacuum pumping. As examples, a NEG may be positioned upstream of the ionization source such as at or near the pump inlet. A NEG may be positioned downstream of the ionization source to capture neutral gas species that passed through the ionization source without being ionized and/or capture neutralized gas species back-streaming from the roughing pump stage. Similarly, a NEG may be positioned between lenses of an ion lens stack of the ion optics to capture back-streaming neutral gas species and to a lesser extent un-ionized gas species. In typical embodiments, a NEG is a layer of material (a lining, coating, film, etc.) disposed on an inside surface of the ITP. Generally, a NEG may be any material that readily sorbs or forms stable compounds with gas species, and is typically an alloy or mixture of metals such as titanium, vanadium, zirconium, aluminum, and iron, as appreciated by persons skilled in the art. As used herein, the term "capture" encompasses chemical reaction and one or more mechanisms of sorption (e.g., adsorption, chemisorption and/or physisorption), unless the context dictates otherwise.

In some embodiments, the ITP (e.g., ITP 100 or 200) may include one or more sputter ion pump (SIP) units to supplement the ITP pumping mechanism. The configuration of such SIP units may be conventional, when considered in isolation from the presently disclosed subject matter.

Figure 6:
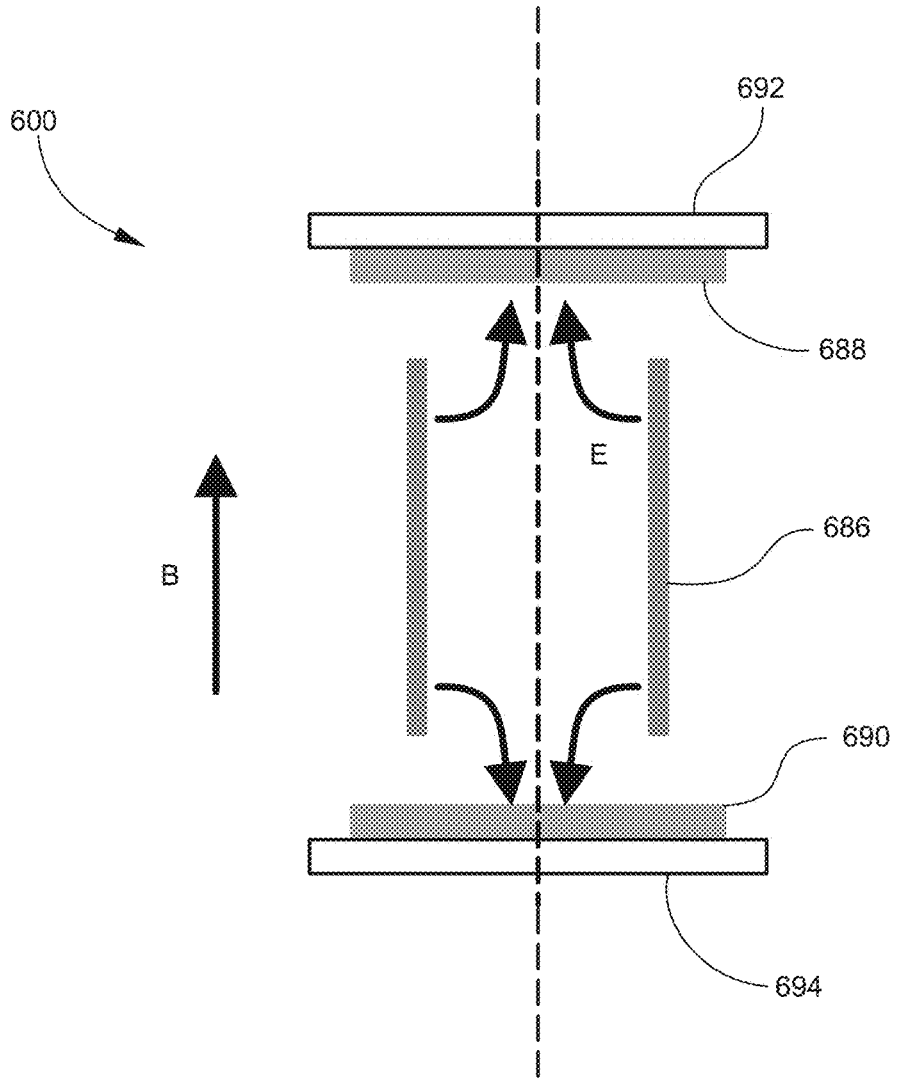
FIG. 6 is a schematic cross-sectional view of an example of a sputter ion pump (SIP) that may be provided or utilized in conjunction with an ITP according to an embodiment.

FIG. 6 is a schematic cross-sectional view of an example of an SIP unit 600. The SIP unit 600 is primarily configured as a Penning ion trap, and thus includes an anode 686 positioned on a longitudinal axis (dashed line) and cathodes 688 and 690 spaced from the opposing axial ends of the anode 686 along the longitudinal axis. The anode 686 is composed of a suitable metal (e.g., stainless steel), and the cathodes 688 and 690 are composed of a chemically active material such as titanium. Typically, the anode 686 is cylindrical with a circular or hexagonal cross-section, and the cathodes 688 and 690 are plate-shaped. With this configuration, a voltage applied to the anode 686 and cathodes 688 and 690 generates an electric field having both axial and radial components, as indicated by curved arrows E. The SIP unit 600 also includes a magnet assembly with magnets 692 and 694 positioned so as to immerse the anode region in an axially oriented magnetic field, as indicated by an arrow B. The SIP unit 600 may have a diode pump, noble diode pump, or triode pump configuration, as appreciated by persons skilled in the art.

In operation, the combination of the electric field E and the magnetic field B imparts a helical or swirling motion to electrons produced by the electric discharge in the anode region. The electrons ionize incoming gas species. The resulting ions are accelerated towards and impact with the cathodes 688 and 690. On impact the ions become buried within the cathode material or physically sputter cathode material onto inside surfaces of the SIP unit 600. The freshly sputtered, still chemically active cathode material acts as a getter that then captures gas species by chemisorption and/or physisorption, thereby in effect removing (or pumping) gas species from the interior.

The SIP unit(s) 600 may be positioned in a variety of locations such as those described above for NEGs. The SIP unit(s) 600 may be operated simultaneously with the ITP, or may be activated once the pressure has been reduced sufficiently (down to a desired vacuum range) through operation of the ITP, at which point the ITP (particularly the ionization source) may be shut off. For an ITP that features a Hall-effect design such as described above and illustrated in FIGS. 2-4, the high-voltage supply may be shared with the SIP(s) 600 to simplify the pump controller and reduce cost. Both NEGs and SIPs 600 may be simultaneously incorporated into an ITP as disclosed herein. In this case the ITP may be configured, and the NEG(s) and SIP(s) 600 may be positioned in the ITP, so as to provide efficient pumping at various pressures and of various gas species (reactive molecules and noble gases).

In some embodiments, the ITP (e.g., ITP 100 or 200) is configured to prevent or at least reduce back-streaming of particles into the vacuum chamber. It is generally not desirable for particles that are formed within the ionization region of the ITP (e.g., ITP 100 or 200) to backstream into the vacuum chamber. For example, sputtered material, either from metal or dielectric surfaces within the ITP, can coat the vacuum chamber or objects within it (e.g., electrodes, optics components, etc.). Sputtered metal can coat dielectric insulators within the vacuum chamber and cause shorting. Charged particles that backstream into the vacuum chamber can interfere with charged particle beam devices, such as electron microscopes. Energetic particles that backstream can impact walls within the vacuum chamber, causing sputtering or producing secondary electrons that can interfere with processes within the vacuum chamber.

Figure 7:
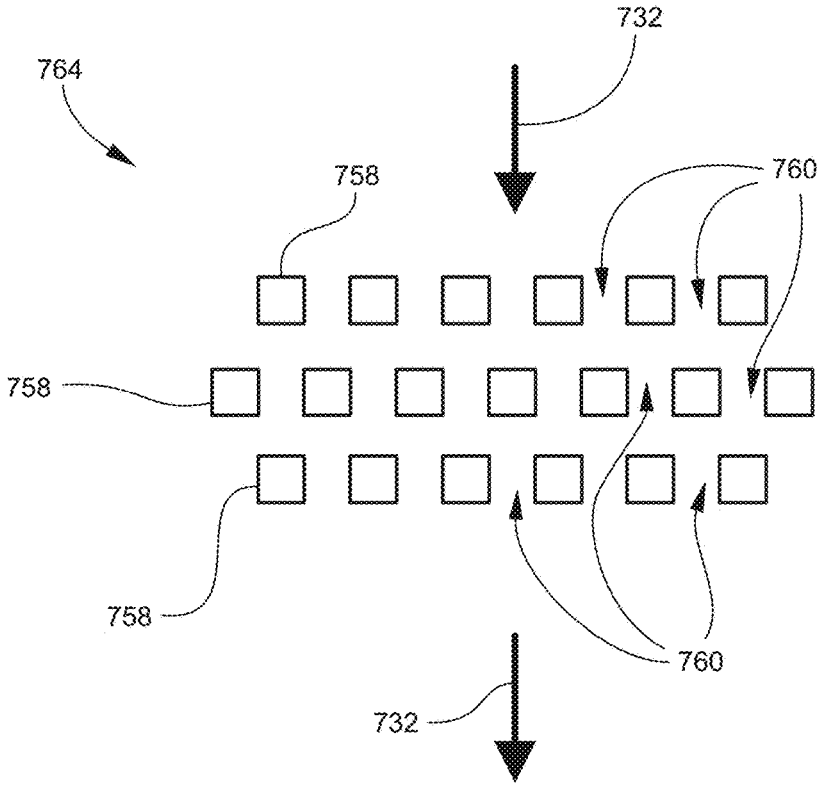
FIG. 7 is a schematic cross-sectional view of an example of an inlet electrode (or electrode assembly) that includes multiple gridded or multi-channel electrodes axially spaced from each other, and having openings or channels offset from each other, according to an embodiment.

FIG. 7 is a schematic cross-sectional view of an example of an inlet electrode (or electrode assembly) 764 configured for preventing (or at least reducing) back-streaming of particles into the vacuum chamber. FIG. 7 also schematically depicts a flow of neutral gas molecules 732 through the inlet electrode 764. In the illustrated example, the inlet electrode 764 is configured to prevent line-of-sight trajectories through the inlet electrode 764 and thus between the ITP and the vacuum chamber. To this end, the inlet electrode 764 may include a plurality or stack of electrodes 758 axially spaced from each other, each electrode 758 having an array of openings or channels 760 through its thickness. Thus, the electrodes 758 may be configured as grids or multi-channel plates. The inlet electrode 764 may include two or three closely spaced electrodes 758 as illustrated, or more than three electrodes 758. The electrodes 758 are arranged in a staggered configuration such that the openings or channels 760 of each pair of adjacent electrodes 758 are offset from one another, thus preventing line-of-sight trajectories and consequently back-streaming of particles into the vacuum chamber. Such an arrangement may reduce the gas flow conductance of the pump inlet. The spacing between the electrodes 758 should be small in comparison to the mean free path of scattering collisions. This is to prevent collisional diffusion of unwanted species, which might allow travel of these species along non-line-of-sight paths and thereby circumvent the shielding effect provided by the staggered configuration.

Particles that impact the inlet electrodes (e.g., electrodes 758) at the entrance of the ITP may cause the emission of secondary electrons from the electrodes themselves. Such electrons are typically released with kinetic energies below 10 eV. In an embodiment, staggered inlet electrodes 758 may be biased with a small potential (10's of V) such that the electrons are recaptured and not allowed to backstream into the vacuum chamber. A multi-channel electrode 758 with a bias potential may be placed in close proximity to another multi-channel electrode 758 with a lower potential. The local electric field lines in this case would terminate on the walls of the channels 760 within the multi-channel electrode 758, and would accelerate electrons into these walls to be recaptured. Magnetic fields, supplied either by electromagnets or permanent magnets, either supplemental to the above-described primary magnetic field of the ITP or an integral part of it, may also be employed to impede these electrons and facilitate their recapture.

Depending on the gas mixture being pumped from the vacuum chamber, it is possible for negatively charged ions to be formed within the ionization region of the ITP. As an example, while $O_2^+$ can be formed via electron impact ionization, $O_2$ possesses an electron affinity and can also form $O_2^-$. Negative ions like this would then be accelerated upstream towards the vacuum chamber instead of towards the roughing pump stage as desired. To prevent back-streaming of negative ions, the inlet electrode 764 may be configured to prevent line-of-sight trajectories as described above. Negative ions that impinge on the inlet electrode 764 would be neutralized. Those neutral molecules that re-enter the ionization region would then have a probability of undergoing reactions that produce a positive ion that can be pumped out of the ITP.

Electron attachment to oxygen molecules is a three-body reaction in which the third body is typically either another oxygen molecule or a water molecule. Such reactions are rare compared to competing reactions at transitional flow regime pressures, and become increasingly negligible as the pressure is reduced into the molecular flow regime. Similarly, other molecular species with electron affinity (e.g., sulfur hexafluoride, $SF_6$) will typically have a range of reactions that can either result in a negative ion (involving low energy electrons with energies below 0.1 eV) or positive ion products (resulting from higher-energy electrons). The effect of negative ions can also be mitigated by flushing the ITP with a gas that exhibits low electron affinity (e.g. nitrogen) prior to pump-down.

In a plasma-based ITP, the plasma discharge in the ionization region will have different fundamental characteristics that will change as the pressure in the region changes. For higher pressures (e.g., 10 mTorr), a portion of the plasma may be in a so-called quasi-neutral state, in which the number of positive (including singly and multiply charged ions) and negative charges (predominantly electrons possibly supplemented by a smaller number of negative ions) are present in nearly the same quantities. This is the typical state associated with plasmas sustained under typical operating conditions. The associated axial electric field in the discharge will tend to be weak in the ionization region, due to the "shielding" effect that the charged plasma particles have on the electric potential. A much stronger electric field will be present closer to the cathode where quasi-neutrality is not present. For lower pressures, a so-called non-neutral plasma may be present in the ionization region of the ITP. Electrons trapped by the radial magnetic field will have a long residence time and outnumber the positive ions present in the discharge, which are rapidly accelerated towards the cathode once they are formed. This electron population will cause a local depression in the potential. This condition is typical of magnetron devices, such as Penning cells (found in conventional ion pumps) operating in the ultrahigh vacuum regime.

Figure 8:
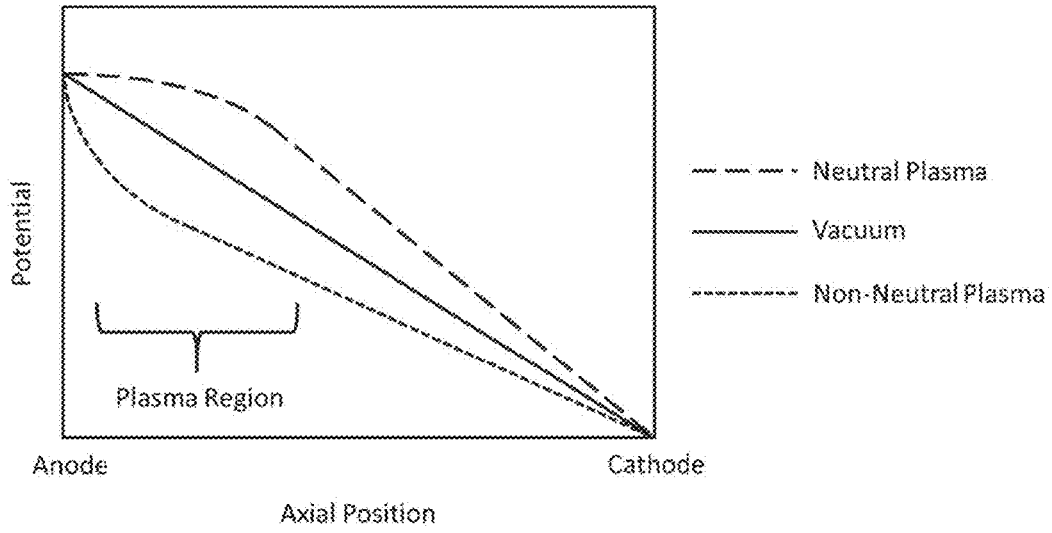
FIG. 8 is a simplified qualitative illustration of the axial potential distribution (potential as a function of axial position between an anode and cathode) for the neutral plasma and non-neutral plasma regimes (and the vacuum potential).

FIG. 8 is a simplified qualitative illustration of the axial potential distribution (potential as a function of axial position between an anode and cathode) for the neutral plasma and non-neutral plasma regimes (and the vacuum potential). It will be noted that in both cases the potential decreases monotonically between the anode and cathode, and the associated axial component of the electric field in all locations points from the anode to the cathode.

The surfaces of ion optics in an ITP may become contaminated during the course of operation. Surface contaminants on the ion optics can act as dielectric films that can accumulate charge, affecting the electric potential provided by the contaminated ion optics component. In some embodiments, in situ plasma cleaning may be performed to reduce this contamination using the same plasma source that is used for the ITP. The gas species and pressure may be controlled during this cleaning phase to maximize the rate of cleaning. The concept of in situ plasma cleaning is described in U.S. Patent Application Pub. No. 2016/0035550, titled PLASMA CLEANING FOR MASS SPECTROMETERS, the entire contents of which are incorporated herein by reference.

It will be understood that various embodiments of an ITP as disclosed herein may include various combinations of features described above, including various combinations of features illustrated in FIGS. 1-8.

EXEMPLARY EMBODIMENTS

Exemplary embodiments provided in accordance with the presently disclosed subject matter include, but are not limited to, the following:

1. An ion throughput pump (ITP), comprising: a pump inlet configured to communicate with a vacuum chamber; an ionization source fluidly communicating with the vacuum chamber and configured for ionizing gas species received from the vacuum chamber; a pump outlet; ion optics configured for accelerating ions produced by the ionization source toward the pump outlet; and a roughing pump stage configured for receiving the ions from the ionization source, producing neutral species from the ions, and pumping the neutral species through the pump outlet.

2. The ITP of embodiment 1, comprising an inlet electrode positioned at or near the pump inlet.

3. The ITP of embodiment 2, wherein the inlet electrode comprises a plurality of openings formed therethrough.

4. The ITP of embodiment 2, wherein the inlet electrode comprises a plurality of inlet electrodes axially spaced from each other.

5. The ITP of embodiment 4, wherein each inlet electrode comprises an opening formed therethrough, and the opening of each inlet electrode is offset from the opening of an adjacent one of the plurality of inlet electrodes.

6. The ITP of embodiment 1, comprising a gas conductance barrier upstream of the roughing pump stage, and configured for establishing an ion path from the ionization source to the roughing pump stage.

7. The ITP of embodiment 6, wherein the gas conductance barrier is an electrode.

8. The ITP of embodiment 6, wherein the gas conductance barrier comprises a plurality of gas conductance barriers axially spaced from each other.

9. The ITP of embodiment 8, wherein each gas conductance barrier comprises an opening formed therethrough, and the opening of each gas conductance barrier is offset from the opening of an adjacent one of the plurality of gas conductance barriers.

10. The ITP of embodiment 6, comprising a bypass conduit configured to provide a fluid flow path from the ionization source to the roughing pump stage while bypassing the gas conductance barrier.

11. The ITP of embodiment 1, wherein the roughing pump stage comprises a plate positioned such that ions received from the ionization source impinge on the plate and are neutralized thereby.

12. The ITP of embodiment 11, wherein the plate is an electrode.

13. The ITP of embodiment 1, comprising a roughing pump unit communicating with the roughing pump stage and configured to pump the vacuum chamber down to rough vacuum.

14. The ITP of embodiment 1, wherein the ionization source comprises a plasma source or a Hall-effect plasma source.

15. The ITP of embodiment 1, wherein the ion optics are arranged generally along a longitudinal axis and are configured for generating an electric field oriented along the longitudinal axis, and the ionization source comprises a magnet assembly configured for generating a magnetic field oriented in a radial direction orthogonal to the longitudinal axis.

16. The ITP of embodiment 1, wherein the ionization source comprises an inner magnet, an outer magnet, and an annular ionization chamber between the inner magnet and the outer magnet.

17. The ITP of embodiment 1, wherein the ionization source comprises an inner magnet, an outer magnet, and an ionization chamber between the inner magnet and the outer magnet, and the ionization chamber comprises a cylindrical section and an annular section between the pump inlet and the cylindrical section.

18. The ITP of embodiment 1, wherein the ionization source comprises an anode and a magnet assembly between the pump inlet and the anode.

19. The ITP of embodiment 1, comprising an inside surface and a non-evaporable getter positioned at the inside surface.

20. The ITP of embodiment 1, comprising an ITP interior and a sputter ion pump positioned in the ITP interior.

21. A method for evacuating a vacuum chamber, the method comprising: receiving gas species from the vacuum chamber into an ionization chamber; generating an electric field in the ionization chamber to produce ions from the gas species and accelerate the ions away from the ionization chamber and toward a pump outlet; neutralizing the ions to produce neutralized species; and pumping the neutralized species out from the pump outlet.

22. The method of embodiment 21, wherein receiving the gas species comprises conducting the gas species through a non-line-of-sight path between the vacuum chamber and the ionization source.

23. The method of embodiment 21, comprising conducting the ions through a gas conductance barrier between the ionization source and the pump outlet.

24. The method of embodiment 23, comprising conducting the ions through a non-line-of-sight path formed by the gas conductance barrier.

25. The method of embodiment 23, comprising, before generating the electric field, conducting the gas species along a bypass path that bypasses the gas conductance barrier.

26. The method of embodiment 25, comprising conducting the gas along the bypass path until the vacuum chamber reaches a rough vacuum level and, after the vacuum chamber reaches the rough vacuum level, closing the bypass path, wherein generating the electric field occurs after the vacuum chamber reaches the rough vacuum level.

27. The method of embodiment 21, wherein pumping the neutralized species out from the pump outlet comprises operating a roughing pump.

28. The method of embodiment 26, comprising, before generating the electric field, operating the roughing pump to pump the gas species out from the pump outlet without ionizing the gas species.

29. The method of embodiment 21, wherein neutralizing the ions comprises directing the ions into impingement with a plate.

30. The method of embodiment 21, comprising generating a plasma or a Hall-effect plasma in the ionization source.

31. The method of embodiment 21, wherein the electric field is oriented along a longitudinal axis, and further comprising generating a magnetic field oriented to confine motions of electrons in the plasma in a radial direction orthogonal to the longitudinal axis.

32. The method of embodiment 21, wherein generating the electric field and neutralizing the ions occur in a pump interior, and further comprising, after the vacuum chamber reaches a desired vacuum range, ceasing generating the electric field and operating a sputter ion pump positioned in the pump interior.

33. The method of embodiment 21, wherein generating the electric field and neutralizing the ions occur in a pump interior, and further comprising a step selected from the group consisting of: capturing gas species, or neutralized species, or both gas species and neutralized species at one or more non-evaporable getters positioned in the pump interior; capturing gas species, or neutralized species, or both gas species and neutralized species in one or more sputter ion pumps positioned in the pump interior; and both of the foregoing.

34. An ion throughput pump (ITP), configured to perform the method of any of the foregoing embodiments.

35. A vacuum system, comprising: an ion throughput pump (ITP) according to any of the foregoing embodiments; and a vacuum chamber communicating with the ITP.

36. The vacuum system of embodiment 35, wherein the vacuum system comprises or is part of a scientific instrument or a fabrication instrument.

It will be understood that the phrases such as "in electrical communication" or "in signal communication" as used herein mean that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion throughput pump (ITP), comprising:

a pump inlet configured to communicate with a vacuum chamber;

an ionization source downstream from the pump inlet and the vacuum chamber, the ionization source configured for ionizing gas species received from the vacuum chamber, wherein the pump inlet defines a path for the gas species to enter the ionization source from the vacuum chamber, and wherein the ionization source comprises a magnet assembly;

a pump outlet;

ion optics arranged generally along a longitudinal axis of the ITP, and configured for accelerating ions produced by the ionization source toward the pump outlet; and a roughing pump stage spaced from the pump inlet along the longitudinal axis, the roughing pump stage configured for receiving the ions from the ionization source, producing neutral species from the ions, and pumping the neutral species through the pump outlet, wherein:

the ionization source defines an ionization region between the pump inlet and the roughing pump stage;

the ion optics are configured for generating an electric field through the ionization region oriented along the longitudinal axis; and the magnet assembly is configured to generate a magnetic field that in the ionization region is predominantly oriented in a radial direction orthogonal to the longitudinal axis, such that the ionization source generates a Hall-effect plasma in the ionization region.

2. The ITP of claim 1, comprising an inlet electrode having a configuration selected from the group consisting of:

the inlet electrode is positioned at or near the pump inlet;

the inlet electrode is positioned at or near the pump inlet, and comprises a plurality of openings formed therethrough;

the inlet electrode is positioned at or near the pump inlet, and comprises a plurality of inlet electrodes axially spaced from each other; and the inlet electrode is positioned at or near the pump inlet, and comprises a plurality of inlet electrodes axially spaced from each other, wherein each inlet electrode comprises an opening formed therethrough, and the opening of each inlet electrode is offset from the opening of an adjacent one of the plurality of inlet electrodes.

3. The ITP of claim 1, comprising a gas conductance barrier having a configuration selected from the group consisting of:

the gas conductance barrier is upstream of the roughing pump stage and is configured for establishing an ion path from the ionization source to the roughing pump stage;

the gas conductance barrier is upstream of the roughing pump stage and is configured for establishing an ion path from the ionization source to the roughing pump stage, wherein the gas conductance barrier is an electrode;

the gas conductance barrier is upstream of the roughing pump stage and is configured for establishing an ion path from the ionization source to the roughing pump stage, wherein the gas conductance barrier comprises a plurality of gas conductance barriers axially spaced from each other;

the gas conductance barrier is upstream of the roughing pump stage and is configured for establishing an ion path from the ionization source to the roughing pump stage, wherein the gas conductance barrier comprises a plurality of gas conductance barriers axially spaced from each other, and wherein each gas conductance barrier comprises an opening formed therethrough, and the opening of each gas conductance barrier is offset from the opening of an adjacent one of the plurality of gas conductance barriers; and the gas conductance barrier is upstream of the roughing pump stage and is configured for establishing an ion path from the ionization source to the roughing pump stage, and further comprising a bypass conduit configured to provide a fluid flow path from the ionization source to the roughing pump stage while bypassing the gas conductance barrier.

4. The ITP of claim 1, wherein the roughing pump stage has a configuration selected from the group consisting of:

the roughing pump stage comprises a plate positioned such that ions received from the ionization source impinge on the plate and are neutralized thereby; and the roughing pump stage comprises a plate positioned such that ions received from the ionization source impinge on the plate and are neutralized thereby, wherein the plate is an electrode.

5. The ITP of claim 1, comprising a roughing pump unit communicating with the roughing pump stage and configured to pump the vacuum chamber down to rough vacuum.

6. The ITP of claim 1, wherein the ionization source has a configuration selected from the group consisting of:

the ionization source comprises an inner magnet, an outer magnet, and an annular ionization chamber between the inner magnet and the outer magnet;

the ionization source comprises an inner magnet, an outer magnet, and an ionization chamber between the inner magnet and the outer magnet, and the ionization chamber comprises a cylindrical section and an annular section between the pump inlet and the cylindrical section; and the ionization source comprises an anode, wherein the magnet assembly is between the pump inlet and the anode.

7. The ITP of claim 1, comprising a supplemental pump selected from the group consisting of:

a non-evaporable getter positioned at an inside surface of the ITP;

a sputter ion pump positioned in an interior of the ITP; and both of the foregoing.

8. The ITP of claim 1, wherein:

the ion optics comprise an inlet electrode positioned at or near the pump inlet, and a downstream electrode positioned downstream from the ionization source; and the downstream electrode is selected from the group consisting of: a gas conductance barrier configured for establishing an ion path from the ionization source to the roughing pump stage; a neutralization element positioned such that ions received from the ionization source impinge on the plate and are neutralized thereby; and both of the foregoing.

9. The ITP of claim 1, comprising a gas conductance barrier downstream from the ionization source and the magnet assembly and upstream of the roughing pump stage, the gas conductance barrier comprising a plate and an orifice extending through the plate, wherein the gas conductance barrier defines a path for the ions from the ionization source, through the orifice, and to the roughing pump stage, and the path is a low-conductance path for neutral gas species.

10. The ITP of claim 1, comprising an inlet electrode positioned at or near the pump inlet, the inlet electrode comprising a plurality of openings formed therethrough, wherein the inlet electrode is part of the path for the gas species to enter the ionization source from the vacuum chamber.

11. A method for evacuating a vacuum chamber, the method comprising:

receiving gas species from the vacuum chamber through a pump inlet into an ionization source downstream from the pump inlet and the vacuum chamber, wherein the pump inlet defines a path for the gas species to enter the ionization source from the vacuum chamber, and wherein the ionization source comprises a magnet assembly;

generating an electric field in the ionization source to produce ions from the gas species and accelerate the ions away from the ionization source and toward a pump outlet;

neutralizing the ions to produce neutralized species; and pumping the neutralized species out from the pump outlet, wherein:

the ionization source defines an ionization region between the pump inlet and the roughing pump stage;

the electric field extends through the ionization region along a longitudinal axis; and the magnet assembly is configured to generate a magnetic field that in the ionization region is predominantly oriented in a radial direction orthogonal to the longitudinal axis, such that the ionization source generates a Hall-effect plasma in the ionization region.

12. The method of claim 11, wherein receiving the gas species comprises conducting the gas species through a non-line-of-sight path between the vacuum chamber and the ionization source.

13. The method of claim 11, comprising a step selected from the group consisting of:

conducting the ions through a gas conductance barrier between the ionization source and the pump outlet; and conducting the ions through a non-line-of-sight path formed by a gas conductance barrier between the ionization source and the pump outlet.

14. The method of claim 11, comprising, before generating the electric field, conducting the gas species along a bypass path that bypasses the gas conductance barrier.

15. The method of claim 14, comprising conducting the gas along the bypass path until the vacuum chamber reaches a rough vacuum level and, after the vacuum chamber reaches the rough vacuum level, closing the bypass path, wherein generating the electric field occurs after the vacuum chamber reaches the rough vacuum level.

16. The method of claim 11, comprising a step selected from the group consisting of:

operating a roughing pump to pump the neutralized species out from the pump outlet;

before generating the electric field, operating a roughing pump to pump the gas species out from the pump outlet without ionizing the gas species; and both of the foregoing.

17. The method of claim 11, wherein neutralizing the ions comprises directing the ions into impingement with a plate.

18. The method of claim 11, wherein the magnetic field is oriented to confine motions of electrons in the plasma in a radial direction orthogonal to the longitudinal axis.

19. The method of claim 11, wherein generating the electric field and neutralizing the ions occur in a pump interior, and further comprising, after the vacuum chamber reaches a desired vacuum range, ceasing generating the electric field and operating a sputter ion pump positioned in the pump interior.

20. The method of claim 11, wherein generating the electric field and neutralizing the ions occur in a pump interior, and further comprising a step selected from the group consisting of:

capturing gas species, or neutralized species, or both gas species and neutralized species at one or more non-evaporable getters positioned in the pump interior;

capturing gas species, or neutralized species, or both gas species and neutralized species in one or more sputter ion pumps positioned in the pump interior; and both of the foregoing.

* * * * *